US009879680B2

(12) United States Patent
Mikkelsen et al.

(10) Patent No.: US 9,879,680 B2
(45) Date of Patent: Jan. 30, 2018

(54) MULTI-STAGE CENTRIFUGAL PUMP UNIT

(75) Inventors: Steen Mikkelsen, Bjerringbro (DK); Aage Bruhn, Bjerringbro (DK); Bo Møller Jensen, Viborg (DK)

(73) Assignee: Grundfos Management a/s, Bjerringbro (DK)

( * ) Notice: Subject to any disclaimer, the term of this patent is extended or adjusted under 35 U.S.C. 154(b) by 635 days.

(21) Appl. No.: 13/433,398

(22) Filed: Mar. 29, 2012

(65) Prior Publication Data

US 2012/0251308 A1 Oct. 4, 2012

(30) Foreign Application Priority Data

Mar. 29, 2011 (EP) ..... 11002578

(51) Int. Cl.

| | |
|---|---|
| ***F04D 9/00*** | (2006.01) |
| ***F04D 1/06*** | (2006.01) |
| ***F04D 13/10*** | (2006.01) |
| ***F04D 9/02*** | (2006.01) |

(52) U.S. Cl.

CPC ..... *F04D 9/005* (2013.01); *F04D 1/063* (2013.01); *F04D 9/02* (2013.01); *F04D 13/10* (2013.01)

(58) Field of Classification Search

CPC ... F04D 9/02; F04D 9/05; F04D 1/063; F04D 1/06; F04D 1/006; F04D 13/08; F04D 13/10

USPC .... 415/56.1, 56.2, 56.3, 56.6, 59.1, 71, 143; 417/423.3, 423.5, 350

See application file for complete search history.

(56) References Cited

U.S. PATENT DOCUMENTS

| | | | | |
|---|---|---|---|---|
| 5,040,946 | A * | 8/1991 | Caoduro | 415/182.1 |
| 5,160,240 | A * | 11/1992 | Wilson | 415/170.1 |
| 5,513,959 | A * | 5/1996 | Mabillot et al. | 417/299 |
| 2005/0196269 | A1 * | 9/2005 | Racer | F04D 9/02 415/62 |
| 2008/0076619 | A1 * | 3/2008 | Scott | F04D 9/02 475/300 |

FOREIGN PATENT DOCUMENTS

| | | | | |
|---|---|---|---|---|
| CN | 2471976 | Y | 1/2002 | |
| CN | 201610847 | U | 10/2010 | |
| DE | 2249883 | A1 * | 5/1973 | F04D 1/08 |
| EP | 0406787 | A2 | 1/1991 | |
| EP | 1729009 | A1 * | 12/2006 | |

OTHER PUBLICATIONS

EP Search Report dated Sep. 15, 2011 in EP Application No. 11002578.0.

Office Action dated May 4, 2016 in CN Application No. 201210094251.1.

* cited by examiner

*Primary Examiner* — Ninh H Nguyen
*Assistant Examiner* — Brian P Wolcott
(74) *Attorney, Agent, or Firm* — Panitch Schwarze Belisario & Nadel LLP

(57) ABSTRACT

A multi-stage centrifugal pump assembly includes at least two impellers (2, 6) and two impeller groups (4, 8) which are consecutive in a flow direction and each with at least one impeller (2, 6). A backflow channel (24) connects an exit side of the first impeller group (4) to an entry side thereof is located in a first impeller group (4) of the two impeller groups (4, 8).

16 Claims, 4 Drawing Sheets

MULTI-STAGE CENTRIFUGAL PUMP UNIT

BACKGROUND OF THE INVENTION

The present invention relates generally to a multi-stage centrifugal pump assembly with at least two impellers, for example an at least two-stage centrifugal pump.

With such multi-stage centrifugal pump assemblies, several impellers are arranged one after the other in the delivery direction, so that a further pressure increase takes place from stage to stage. A problem with these centrifugal pump assemblies is that they firstly need to be bled and filled with fluid on starting operation. The centrifugal pump assemblies are not self-priming. This is disadvantageous with certain case of application, for example in fire extinguishing devices, with which a constant filling with fluid, in particular water cannot be ensured. It is important for the applied pumps to be self-priming in such devices.

BRIEF SUMMARY OF THE INVENTION

It is therefore an objective of the present invention to improve a multi-stage centrifugal pump assembly to the extent that it is self-priming.

The multi-stage centrifugal pump assembly according to a preferred embodiment of the present invention includes at least two impellers which are preferably arranged on a common shaft and via this shaft are driven by a motor, in particular an electric motor.

The multi-stage centrifugal pump assembly is constructed such that it includes two impeller groups which are successive in the flow direction, for examples groups of pump stages, in which at least one impeller is present in each case. The impeller group which is first in the flow direction is thereby designed such that it permits a self-priming behavior of the centrifugal pump. For this, a backflow channel (return flow channel) which connects the exit side of the first impeller group to its entry side, is present in the first impeller group. This backflow channel permits a fluid flow through the backflow channel and through the impeller to be effected within the first impeller group, by way of its at least one impeller. For example, a limited fluid quantity can be circulated in the first impeller group. This circulating fluid quantity effects an adequate suction effect in the first impeller group, in order to suck further fluid. Thus, the complete centrifugal pump assembly can automatically suck fluid. It is merely preferable for a limited fluid quantity to always be present in the first impeller group, in particular in the backflow channel, in order to ensure that the circulating flow through the impeller of the first impeller group and the backflow channel can set in, on starting operation of the pump.

The backflow channel preferably runs out into the suction port of a first stage of the first impeller group. By way of this, one succeeds in the fluid flowing through the backflow channel being fed again to the entry side of the impeller of the first stage, so that a circulating delivery flow is achieved here.

Further preferably, at least one valve for closing the backflow channel is present in the backflow channel. The backflow channel can be closed by way of this valve when the pump has reached its normal operating condition. In the normal operating condition, when the pump assembly delivers fluid, an open backflow channel and a constant fluid return would worsen the efficiency of the centrifugal pump assembly. By way of closing the valve, this can be prevented after running up the pump, so that the pump functions just as a conventional multi-stage centrifugal pump.

Preferably, the valve is designed in a manner such that it closes the backflow channel on reaching a predefined fluid pressure in the backflow channel or at the exit side of the first impeller group. The reaching of the predefined fluid pressure is recognized as a normal operating condition or an operating condition, in which an adequate delivery flow is already present on sucking further fluid. Preferably, the fluid pressure in the backflow channel, for example at the exit side of the first impeller group is detected by the valve. The valve is preferably designed as a spring element, wherein it is held open by way of a spring effect, against the fluid pressure prevailing in the backflow channel. The valve is closed when the fluid pressure exceeds the spring force. Thus, an opening can be provided in the backflow channel, and a spring sheet-metal part lies in front of this opening in the flow direction and is curved such that the sheet-metal part is distanced to the opening in its idle position. By way of increased fluid pressure, the sheet-metal part can be deformed against its spring biasing such that it is pressed against the opening and closes this.

Further preferably, the first impeller group is designed with at least two stages with two impellers which are arranged one after the other in the flow direction. Thereby, the backflow channel is arranged such that it leads from the exit side of the second impeller to the entry side of the first impeller. An adequate flow and an adequate suction can be achieved by of delivering the fluid in the circuit through the backflow channel, by way of the two-stage first impeller group, in order as a whole to produce an adequate vacuum in the suction port or suction channel of the centrifugal pump assembly, for sucking fluid.

A separating element is preferably arranged on the exit side of the first impeller group and is designed for separating air and fluid. It is indeed on starting up the pump assembly when firstly only a small amount of fluid is delivered through the backflow channel that the centrifugal pump assembly also sucks air through its suction conduit, wherein air and fluid ideally mix on entry into the first impeller. For this reason, it is useful to separate the air form the fluid at the exit side of the first impeller group, in order to lead back preferably exclusively fluid through the backflow channel back to the entry side of the first impeller group. Thus, one prevents the backflow channel from running dry.

For this reason, the separating element is further preferably arranged relative to the backflow channel such that the fluid exiting from the separating element enters into the backflow channel. Thus, it is ensured that the fluid flowing out of the backflow channel into the first impeller group, when it exits from the first impeller group again, essentially enters completely into the backflow channel, in order to thus produce a circuit.

Preferably, a check valve or a backflow preventer, which prevents fluid from being able to run out of the centrifugal pump assembly back into a suction conduit, is arranged on the entry side of the first impeller group. Thus one prevents the centrifugal pump assembly from being able to run completely dry, and rather, fluid is held in the inside of the centrifugal pump assembly by way of the check valve, even when the centrifugal pump assembly is out of operation, and this fluid permits the restarting and a renewed sucking. The check valve can be integrated directly into the centrifugal pump assembly, but can however also be applied onto the suction connection of the centrifugal pump assembly as a separate component.

According to a further preferred embodiment of the present invention, at least one fluid storage means is arranged between the first and the second impeller group. The fluid storage means is designed such that it fills with fluid on normal operation of the centrifugal pump assembly. When the centrifugal pump assembly is out of operation or in the case that the centrifugal pump assembly should deliver air bubbles, by way of the fluid in the fluid storage means, one can ensure that the delivery effect of the centrifugal pump assembly is not completely absent, but that enough fluid is always present in the centrifugal pump assembly, to permit a renewed sucking of fluid through the suction connection or suction conduit of the centrifugal pump assembly.

The fluid storage means preferably includes at least one exit opening which is arranged in a manner such it lies opposite an entry opening of the backflow channel such that fluid can flow out of the fluid storage means into the backflow channel. Thus one succeeds in the backflow channel firstly being filled or being kept filled by way of the fluid storage means. The fluid from the backflow channel then flows to the entry side of the first impeller of the first compeller group and enters into this, so that this impeller can immediately achieve a delivery effect and suck further fluid through the suction conduit. Then, as described above, the fluid in the backflow channel is firstly delivered in the first impeller group in the circuit, until fluid from the suction conduit enters into the first impeller.

The centrifugal pump assembly according to a preferred embodiment of the present invention is preferably designed such that the rotation axis of the impellers extends vertically. The previously described fluid storage means is then preferably designed such that its exit opening is arranged on the lower side, so that fluid can exit downwards out of the fluid storage means due to gravity and enter into the backflow channel. The fluid storage means is preferably filled from above via the fluid flowing to the pump stages arranged behind the fluid storage means or above the fluid storage means. The backflow channel preferably comprises an upwardly directed opening, so that the fluid from the fluid storage means can enter into this opening from above.

According to a further preferred embodiment of the present invention, at least two fluid storage means can be arranged in a manner such that an exit opening of the second fluid storage means runs out into an opening of the first fluid storage means. Thus, two or more fluid storage means can be arranged in the flow direction or delivery direction one after the other between the first impeller group and the second impeller group. Thereby, the fluid from the first or lower fluid storage means, as previously described, preferably flows into the backflow channel. The fluid from the second or subsequent fluid storage means firstly flows into the first fluid storage means and from this then into the backflow channel. Accordingly, fluid can flow over from a third fluid storage means into the second fluid storage means. All fluid storage means preferably have an exit opening on the lower side, and an exit opening on the upper side.

Particularly preferably, the at least one fluid storage means is designed as an annular pot with an open upper side which surrounds a shaft driving the impellers. For example, the pot is annular or toroidal and in the middle comprises an opening, through which the shaft extends. The opening moreover serves as a flow path for the fluid to be delivered from the first impeller group to the second impeller group. For this, a free space surrounding the shaft is provided in the opening. The pot-like fluid storage means is designed in an open manner at its upper side, so that fluid which flows through the central opening can flow over the edge of the opening from above into the pot-like fluid storage means. The described at least one exit opening is preferably designed on the lower side. With the arrangement of several fluid storage means, the exit openings of the subsequent fluid storage means are arranged such that they are situated above the upper side of the respective preceding fluid storage means, so that the fluid can flow out of the exit opening into the preceding fluid storage means. The fluid flows from the first, for example lowermost fluid storage means out of the exit opening, as described, into the backflow channel. The exit openings are dimensioned with regard to size such that the fluid storage means empty slowly.

According to a particularly preferred embodiment of the present invention, the individual impellers of the second impeller group are each arranged in a stage module, wherein all stage modules have the same axial height and the at least one impeller of the first impeller group is likewise arranged in such a stage module which has an axial height which corresponds to the axial height of or an integer multiple of the height of a stage module of the second impeller group. This modular construction with a fixed grid pattern of axial heights or lengths of individual modules has the advantage that centrifugal pump assemblies of different powers, in particular different delivery heads or suction heads can be very easily realized from the modules. The first self-priming impeller group can be also easily integrated into conventional multi-stage centrifugal pumps, since the parts of the first impeller group in their axial length have the same grid pattern as the modules of the second impeller group. Thus, for example the same tightening belts as are used with conventional multi-stage centrifugal pump assemblies can be used for holding the modules together. The necessary variety of parts can be reduced by way of this.

Further preferably, the fluid storage means or spacer elements, which are arranged between the two impeller groups, in each case likewise have an axial height which corresponds to the axial height or an integer multiple of this height of a stage module of the second impeller group. Thus also with respect to these components, one succeeds in the axial height fitting into the present grid pattern of the axial height of the individual pump stages which are arranged in the second impeller group.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
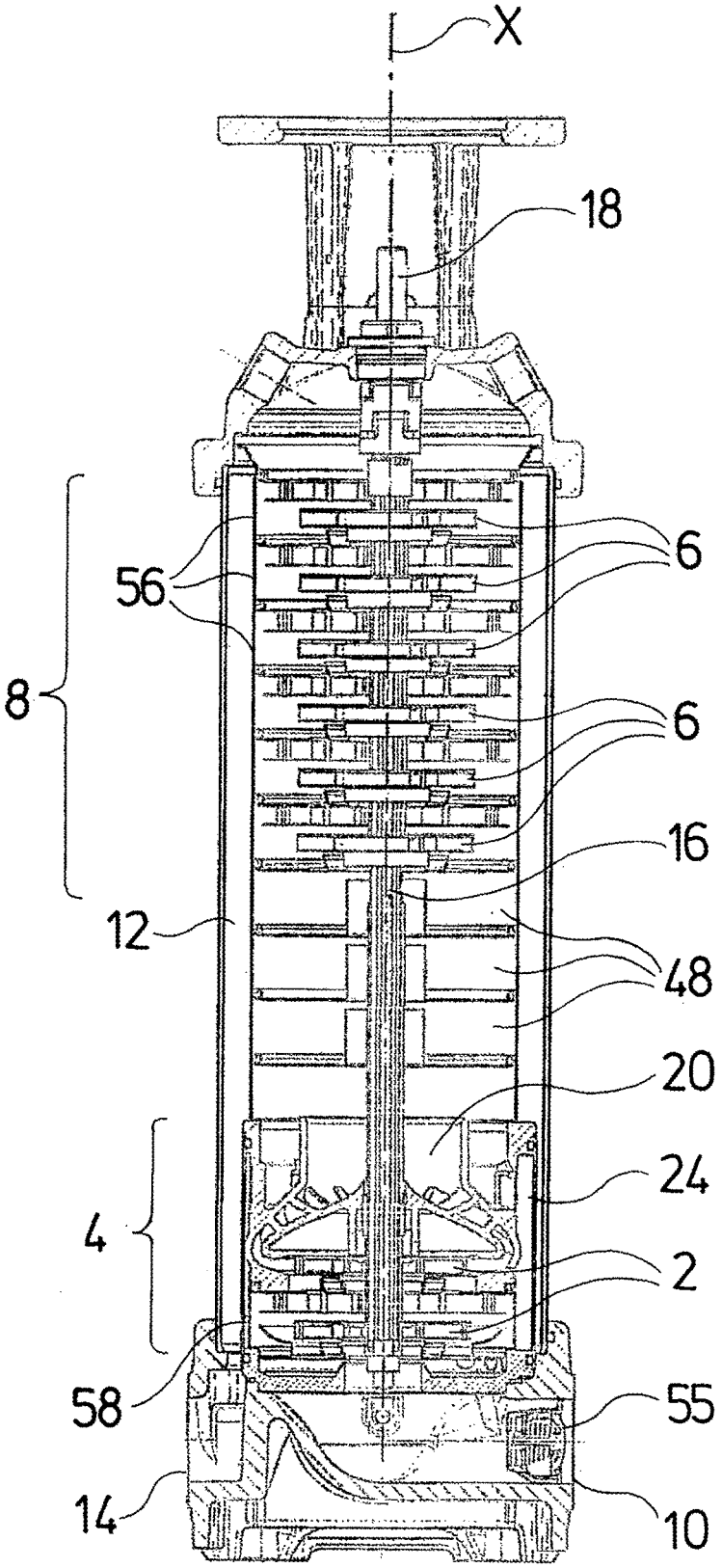
FIG. 1 is a sectioned view of a pump assembly according to a preferred embodiment of the present invention.

Certain terminology is used in the following description for convenience only and is not limiting. The words "lower,"

"upper," "top" and "front" designate directions in the drawings to which reference is made. The word "outwardly" refers to a direction away from, respectively, the geometric center of the device, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

The centrifugal pump assembly described by way of example preferably includes in total eight stages, for example eight impellers. Of these impellers, two impellers 2 are arranged in the first impeller group 4 and six impellers 6 are arranged in a second impeller group 8. The first impeller group 4 faces the inlet connection or suction connection 10 of the pump assembly. The second impeller group 8 is connected downstream of the first impeller group in the flow direction or delivery direction. As with known multi-stage centrifugal pump assemblies, the fluid to be delivered flows through the individual impellers one after the other and at the exit side of the last impeller 6 is led to the pressure connection 14 via the annular pressure channel 12. All impellers 2, 6 are driven via a common shaft 16. The shaft 16 at its shaft end 18 is connected to a motor which is not shown here, for example to an electric motor for the drive.

The first impeller group 4 is designed in a self-priming manner in the subsequently described manner, so that the centrifugal pump can also suck fluid via the suction connection 10 when the suction connection 10 and a suction conduit connecting upstream are not filled with fluid.

Figure 2:
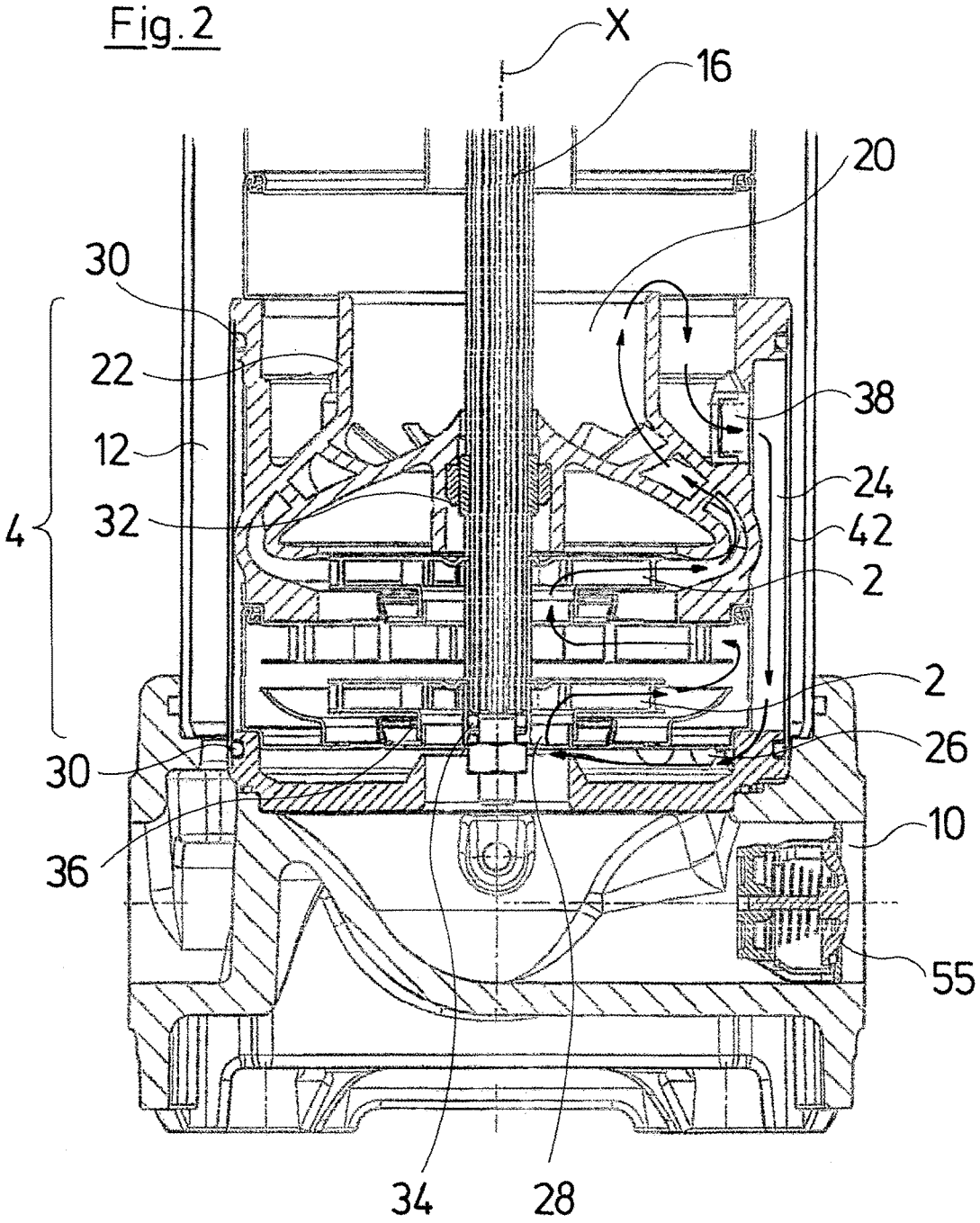
FIG. 2 is an enlarged detailed view of a first impeller group of the pump assembly according to FIG. 1.

The self-priming effect of the first impeller group 4 is achieved by the design which is explained in more detail by way of FIG. 2. A separating element 20 is arranged on the exit side of the impeller 2 of the first impeller group 4 which is second in the flow direction. This separating element is designed such that fluid and air are separated from one another. This is effected by way of the fluid being accelerated radially outwardly, so that the air exits from the separating element 20, in the central region close to the shaft 16, and the fluid exits in the peripheral region close to the peripheral wall 22. The fluid exiting from the separating element 20 flows over the peripheral wall 22 at its upper edge and enters into a backflow channel 24. The backflow channel 24 at the outer periphery of the first impeller group 4 leads back in the direction of the suction connection 10. The backflow channel via openings 26 in a base plate leads to the suction port 28 of the impeller 2 of the first impeller group 4 which is first in the flow direction. Thus a closed fluid circuit is realized via the two impellers 2 of the separating element 20, back through the backflow channel 24 to the section port 28 of the first impeller 2.

For starting the pump, a small fluid quantity is sufficient in order to put the described circuit through the two impellers 2 and the backflow channel 24 into operation. By way of this, the impellers 2 produce a vacuum, by way of which further fluid can be sucked through the suction connection 10. On first starting operation of the pump, it is necessary to bleed the pump assembly as is the case with conventional centrifugal pump assemblies, for example to fill it with a certain quantity of fluid.

In order to be able to maintain the described circulation via the return flow conduit 24, it is important to design the pump as airtight as possible manner in the region of the first impeller group 4. Various seals are arranged for this. The seals 30 seal the backflow channel 24 with respect to the pressure channel 12, so that one prevents fluid from being able to flow over from the pressure side via the backflow channel 24 to the suction side in normal operation. A bearing 32 is arranged in the inside of the separating element 20 and is in contact with the outer periphery of the shaft 16. This bearing simultaneously serves for sealing the separating element 20 with respect to the shaft 16, in order to prevent air from being able to flow out of the separating element 20 back to the impellers 2. The seal 34 seals the axial end of the shaft 16, in order to prevent air from flowing from the pressure side of the pump via the shaft to the suction side. The seal 36 likewise serves for separating the pressure side from the suction side, for example for sealing the pressure connection 14 with respect to the suction connection 10.

A valve 38 is arranged in the backflow channel 24, in order to prevent fluid from flowing via the backflow channel 24 back to the suction side, after reaching the normal operating condition, in which fluid is sucked through the suction connection 10. This valve 38 is designed such that it closes the backflow channel on reaching a predefined pressure at the exit side of the second impeller 2, for example at the exit side of the separating element 20 and in the backflow channel 24. For example, the backflow channel 24 is closed after reaching this predefined pressure and the fluid flows exclusively to the subsequent impellers 6 of the second impeller group 8.

Figure 3:
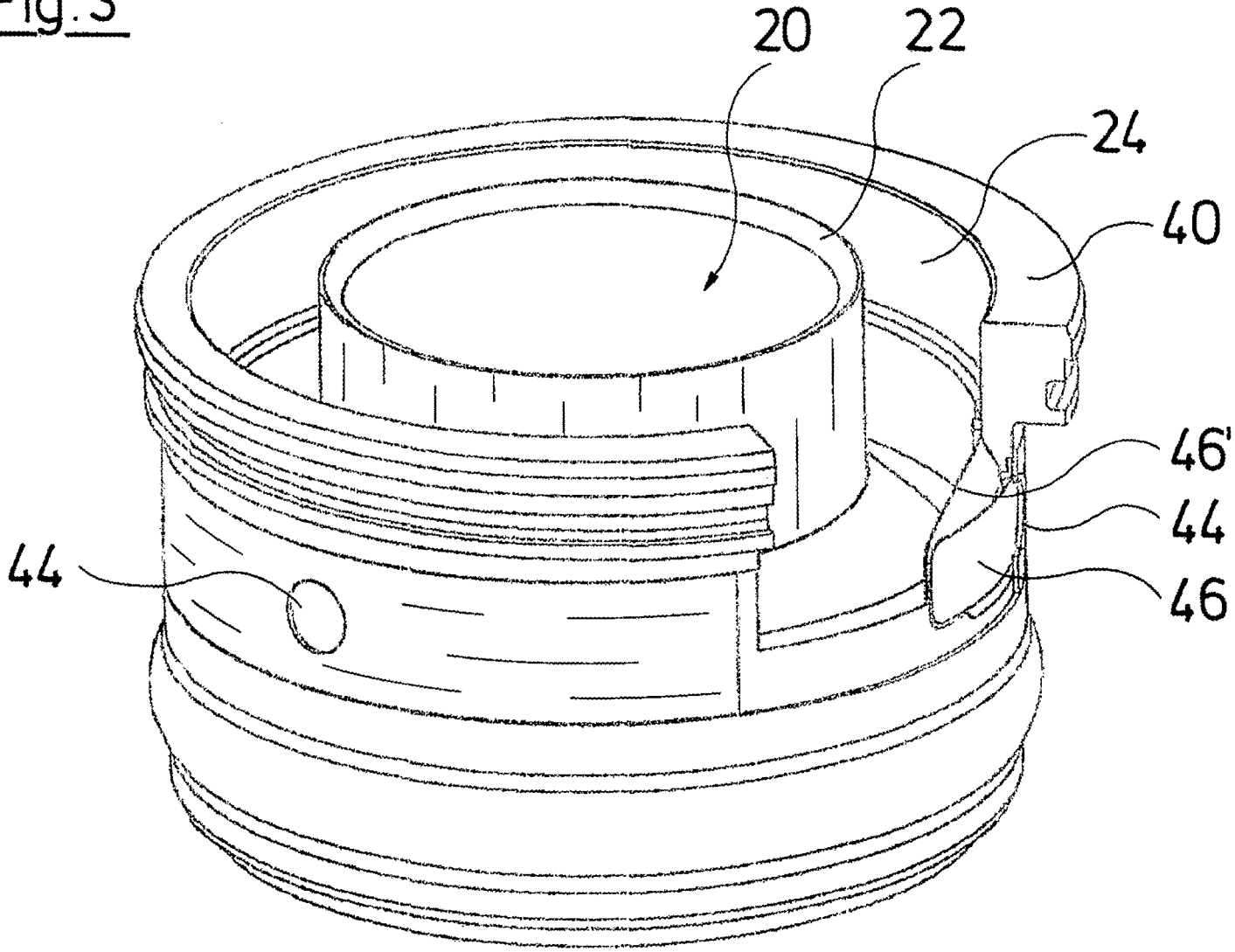
FIG. 3 is a partly sectioned enlarged detailed view of a valve in a backflow channel.

The design of the valve 38 is explained in more detail by way of FIG. 3. FIG. 3 shows a detailed view of the separating element 20. The separating element 20, between the outer periphery of the peripheral wall 22 and an annular wall 40 situated further radially outwardly, defines a first section of the backflow channel 24 which forms an entry region of the backflow channel 24. The second section of the backflow channel 24 is defined between the outer periphery of the wall 40 and a radially distanced sleeve 42 (see FIG. 2). Several holes 44 are formed in the wall 40, which permit the transfer from the inlet region of the backflow channel 24 into the second section of the backflow channel 24 between the wall 40 and the sleeve 42. Valve elements in the form of spring sheet-metal parts 46 are arranged on the openings 44. These spring sheet-metal parts 46 can assume two positions, specifically and firstly an opened position which is indicated in FIG. 3 with the reference numeral 46'. In this position, the spring sheet-metal part 46' extends in a sickle-like manner to the inner periphery of the wall 40 and is this distanced to the opening 44, so that this is released. If now the pressure in the region of the backflow channel 24 which is situated between the peripheral wall 22 and the wall 40 now rises, the spring sheet-metal part 46' is pressed radially outwards and bears on the inner side of the wall 40 over the opening 44, so that the opening 44 is closed.

Figure 4:
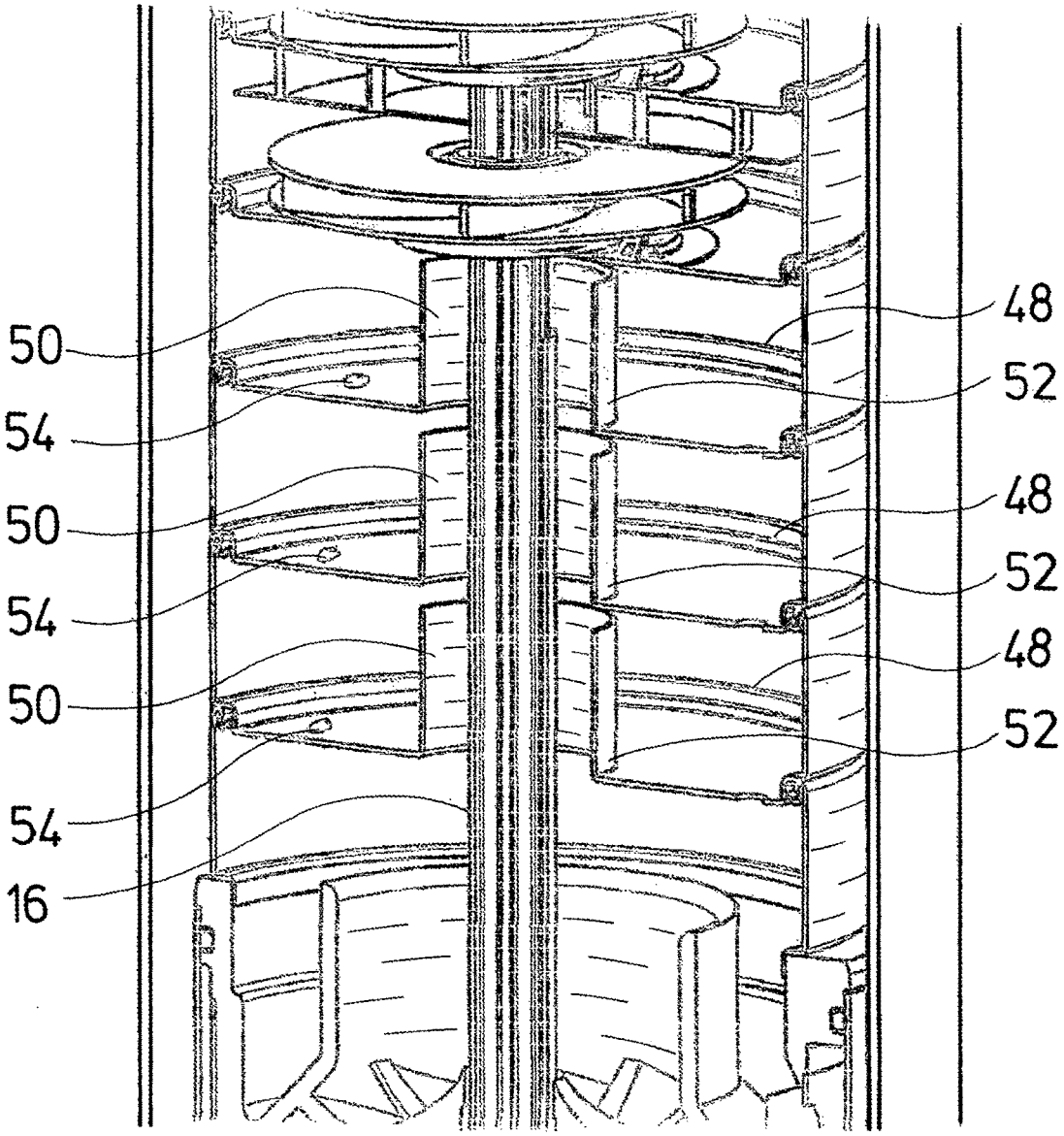
FIG. 4 is an enlarged sectioned view of the fluid storage means of the pump assembly according to FIG. 1.

Three fluid storage means 48 are arranged between the first impeller group 4 and the second impeller group 8, in order to ensure the reliable operation of the centrifugal pump assembly even if larger air bubbles pass the system. These fluid storage means are shown in detail in FIG. 4. The fluid storage means 48 are designed as annular or toroidal pots which surround the shaft 16. The shaft 16 extends through a central opening 50 of the fluid storage means 48, wherein the wall of the opening 50 is distanced radially to the outer periphery of the shaft 16. Thus, the opening 50 also serves as a flow path for the delivered fluid from the first impeller group 4 to the second impeller group 8. The peripheral walls 52 of the openings 50 thereby in the direction of the longitudinal axis X have a length which is shorter than the axial length of the outer walls of the fluid storage means 48. Thus, the fluid storage means 48 are open at their upper side, so that fluid which flows through the openings 50 can flow beyond the peripheral walls 52 into the inside of the fluid storage means 48. Thus, the fluid storage means 48 are filled in normal operation of the pump assembly when fluid flows from the first impeller group 4 to the second impeller group 8.

Each fluid storage means 48 on its lower side comprises an outlet opening 54 with a small diameter. The outlet openings 54 are distanced so far from the longitudinal axis X, that they lie above the free space between the peripheral wall 22 and the wall 40 of the separating element 20. Thus, the fluid runs out of the first, for example lower fluid storage means 48 directly into the backflow channel 24. The fluid runs out of the two other fluid storage means 48 via the associated outlet opening 54 firstly into the fluid storage means 48 situated therebelow. By way of the fact that the fluid slowly runs away out of the fluid storage means 48 via the small outlet opening 54, one can ensure that an adequate fluid quantity is still present in the pump assembly in order to be able to again start operation at least of the starting circuit or circulation through the first impeller group 4, for example through the backflow channel 24 in the described manner, even if larger air bubbles or gas bubbles flow through the pump assembly.

Apart from these measures, a check valve or backflow preventer 55 is yet arranged on or in the suction connection 10. Here, the check valve 55 is arranged directly in the suction connection, but it could however also be applied on the suction connection 10 as a separate component. Via such a connection, one can prevent the fluid running out of the pump assembly through the suction connection 10 back into the suction conduit, should the suction conduit connecting to the suction connection 10 run dry. Thus, a certain fluid quantity can always be held in the pump assembly, via which quantity at least the starting circuit in the first impeller group 4 can be taken into operation, in order to then suck further fluid through the suction connection 10. In this manner, the complete centrifugal pump assembly is designed in a self-priming manner.

As can be recognized in FIG. 1, the pump assembly as whole is constructed in a modular manner, wherein an axial length grid pattern forms the basis of this modular construction, said length grid pattern being defined by the axial length of the pump stages formed by the impellers 6. These pump stages in each case comprise a peripheral casing 56 which forms the casing of the individual stage modules. These stage modules are applied axially onto one another. The fluid storage means 48 have the same axial length as the casings 56 of the stage modules of the second impeller group 8. Moreover, a casing 58 which surrounds the first impeller 2, has the same axial length. The separating element 20 has an axial length in the direction of the longitudinal axis X, which corresponds to double the axial length of the casings 56 and 58. Thus, the complete first impeller group 4 has an axial length which corresponds to threefold the length of a stage module of the second impeller group 8. This uniform length grid pattern favors the modular construction, since tightening belts which hold the individual stage modules together in the axial direction, only need to be kept in different lengths which are defined by this basic pattern. With this, various pumps can be constructed, with different numbers of impellers, fluid storage means 48 and, as the case may be, the first impeller group 4, in order to ensure self-priming characteristics.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A multi-stage centrifugal pump assembly comprising:

at least two impellers (2, 6);

two impeller groups, including a first impeller group (4) and a second impeller group (8), positioned consecutively on a same shaft in a flow direction that flows from an inlet connection (10) of the pump assembly, with each impeller group having at least one of the at least two impellers (2, 6); and a backflow channel (24) located entirely within the first impeller group (4) having an entrance positioned between the first impeller group (4) and the second impeller group (8), wherein at least one valve (38) for closing the backflow channel (24) is located in the backflow channel (24) at an exit side of the first impeller group (4), and wherein the first impeller group (4) at an exit side thereof comprises a separating element (20) for separating air and other fluid, and wherein the first impeller group (4) is designed with at least two-stages with two impellers (2) arranged one after the other in the flow direction, wherein one of the two impellers is an impeller of the at least two impellers.

2. The multi-stage centrifugal pump assembly according to claim 1, wherein the backflow channel (24) runs out into a suction port (28) of a first stage of the first impeller group (4).

3. The multi-stage centrifugal pump assembly according to claim 1, wherein the at least one valve (38) is designed in a manner such that on reaching a predefined fluid pressure in the backflow channel (24), the at least one valve (38) closes the backflow channel (24).

4. The multi-stage centrifugal pump assembly according to claim 1, wherein the separating element (20) is arranged relative to the backflow channel (24) such that the fluid exiting from the separating element (20) enters into the backflow channel (24).

5. The multi-stage centrifugal pump assembly according to claim 1, wherein a check valve is arranged on the entry side of the first impeller group (4).

6. The multi-stage centrifugal pump assembly according to claim 1, wherein at least one fluid storage device (48) is arranged between the first impeller group (4) and the second impeller group (8).

7. The multi-stage centrifugal pump assembly according to claim 6, wherein the at least one fluid storage device (48) is an annular pot with an open upper side which surrounds a shaft (16) driving the impellers (2, 6).

8. The multi-stage centrifugal pump assembly according to claim 1, wherein each impeller of the second impeller group (8) is arranged in one or more stage modules, wherein all stage modules have the same axial height, and the at least one impeller (2) of the first impeller group (4) is arranged in a stage module which has an axial height which corresponds to an axial height or an integer multiple of an axial height of a stage module of the second impeller group (8).

9. The multi-stage centrifugal pump assembly according to claim 8, wherein fluid storage devices (48) or spacer elements, which are arranged between the two impeller groups (4, 8), have an axial height which corresponds to an axial height or an integer multiple of the axial height of the stage module of the second impeller group (8).

10. A multi-stage centrifugal pump assembly comprising:

at least two impellers (2, 6);

two impeller groups comprising a first impeller group (4) and a second impeller group (8) arranged on a same shaft, each impeller group having at least one of the at least two impellers (2, 6); and a backflow channel (24) located within the first impeller group (4) having an entrance positioned between the first impeller group (4) and the second impeller group (8), wherein at least two fluid storage devices (48) are arranged in a manner such that an exit opening of a second fluid storage device (48) runs out into an opening of a first fluid storage device (48).

11. The multi-stage centrifugal pump assembly according to claim 1, wherein the separating element (20) comprises a peripheral wall (22), a central region close to the shaft (16), and a peripheral region close to the peripheral wall (22), and wherein within the separating element (20) fluid is accelerated radially outwardly, so that air exits from the separating element (20) in the central region, and the other fluid exits from the separating element (20) in the peripheral region.

12. The multi-stage centrifugal pump assembly according to claim 11, wherein the peripheral wall (22) has an upper edge, and the other fluid exiting from the peripheral region flows over the peripheral wall (22) at the upper edge thereof.

13. The multi-stage centrifugal pump assembly according to claim 11, wherein the separating element (20) is arranged relative to the backflow channel (24) such that the other fluid exiting from the separating element (20) enters into the backflow channel (24).

14. The multi-stage centrifugal pump assembly according to claim 12, wherein the separating element (20) is arranged relative to the backflow channel (24) such that the other fluid exiting from the separating element (20) enters into the backflow channel (24).

15. A multi-stage centrifugal pump assembly comprising:

at least two impellers (2, 6);

two impeller groups, including a first impeller group (4) and a second impeller group (8), positioned consecutively on a same shaft in a flow direction that flows from an inlet connection (10) of the pump assembly, with each impeller group having at least one of the at least two impellers (2, 6); and a backflow channel (24) located entirely within the first impeller group (4) having an entrance positioned between the first impeller group (4) and the second impeller group (8), wherein at least one valve (38) for closing the backflow channel (24) is located in the backflow channel (24) at an exit side of the first impeller group (4), and wherein the first impeller group (4) at an exit side thereof comprises a separating element (20) for separating air and other fluid, and wherein at least one fluid storage device (48) is arranged between the first impeller group (4) and the second impeller group (8), and wherein the at least one fluid storage device (48) comprises at least one exit opening arranged in a manner to lie opposite an entry opening of the backflow channel (24) in a manner such that fluid can flow out of the at least one fluid storage device (48) into the backflow channel (24).

16. A multi-stage centrifugal pump assembly comprising:

at least two impellers (2, 6);

two impeller groups, including a first impeller group (4) and a second impeller group (8), positioned consecutively on a same shaft in a flow direction that flows from an inlet connection (10) of the pump assembly, with each impeller group having at least one of the at least two impellers (2, 6); and a backflow channel (24) located entirely within the first impeller group (4) having an entrance positioned between the first impeller group (4) and the second impeller group (8), wherein at least one valve (38) for closing the backflow channel (24) is located in the backflow channel (24) at an exit side of the first impeller group (4), and wherein the first impeller group (4) at an exit side thereof comprises a separating element (20) for separating air and other fluid, and wherein at least two fluid storage devices (48) are arranged between the first impeller group (4) and the second impeller group (8) in a manner such that an exit opening of a second fluid storage device (48) runs out into an opening of a first fluid storage device (48).

* * * * *